US007273417B1

(12) United States Patent
Lundquist

(10) Patent No.: US 7,273,417 B1
(45) Date of Patent: Sep. 25, 2007

(54) GOLF PRACTICE AID

(76) Inventor: Steven W. Lundquist, Suite 3002, 1830 Eagle Ridge Dr., Mendota Heights, Dakota, MN (US) 55118

( * ) Notice: Subject to any disclaimer, the term of this patent is extended or adjusted under 35 U.S.C. 154(b) by 0 days.

(21) Appl. No.: 11/043,299

(22) Filed: Jan. 25, 2005

(51) Int. Cl.
*A63B 69/36* (2006.01)

(52) U.S. Cl. ..... 473/265; 473/257

(58) Field of Classification Search ..... 473/265, 473/257, 261, 278, 218, 219, 266, 270, 264
See application file for complete search history.

(56) References Cited

U.S. PATENT DOCUMENTS

| | | | | |
|---|---|---|---|---|
| 2,152,381 | A | 3/1939 | Harpster | |
| 2,712,939 | A | 7/1955 | Harp | |
| 2,992,005 | A | 7/1961 | Lockhart | |
| 3,166,326 | A | 1/1965 | Mundy, III | |
| D234,210 | S | 1/1975 | Menendez et al. | |
| 3,899,179 | A | 8/1975 | Vlach | |
| 4,023,811 | A * | 5/1977 | DeCota | 473/265 |
| D277,886 | S | 3/1985 | Murphy | |
| 4,826,174 | A * | 5/1989 | Hoyt, Jr. | 473/157 |
| 4,913,440 | A | 4/1990 | Ellington | |
| D311,568 | S | 10/1990 | Jacques | |
| 5,042,814 | A | 8/1991 | Bennett | |
| D332,817 | S | 1/1993 | Mullen | |
| D336,618 | S | 6/1993 | Smith | |
| D338,940 | S | 8/1993 | Pellington | |
| 5,320,355 | A | 6/1994 | Johnson | |
| 5,350,177 | A | 9/1994 | Furbush, Jr. | |
| 5,362,057 | A | 11/1994 | Arima | |
| 5,411,266 | A | 5/1995 | Guthry | |
| 5,429,368 | A * | 7/1995 | Adams | 473/162 |
| 5,776,007 | A | 7/1998 | Kendall et al. | |
| 5,785,604 | A * | 7/1998 | Johnson | 473/265 |
| D402,347 | S | 12/1998 | Murphy | |
| D406,298 | S | 3/1999 | Murphy | |
| 5,882,267 | A | 3/1999 | Roe | |
| 5,910,053 | A | 6/1999 | Scalise | |
| 6,443,852 | B1 * | 9/2002 | Kim | 473/265 |
| D470,906 | S | 2/2003 | Shaw | |
| 6,773,357 | B2 | 8/2004 | Tai et al. | |
| 6,786,833 | B2 | 9/2004 | Ahrend | |
| 6,840,870 | B1 * | 1/2005 | Froggatte | 473/265 |
| 6,923,730 | B1 * | 8/2005 | Potter | 473/257 |

* cited by examiner

*Primary Examiner*—Nini F. Legesse
(74) *Attorney, Agent, or Firm*—Albert W. Watkins

(57) ABSTRACT

A golf practice aid includes two parallel rails separated by crossed spacers. The distance of separation is sufficient to reasonably accommodate a golf club head therebetween, and is contemplated to be adjustable. Within the parallel rows are a line of holes for receiving golf tees. The tees then are placed to form two parallel rows spaced about the position the ball is to be located. Swing path and deviation is visually monitored by the pattern of tees that are displaced from holes after the swing is complete. To accommodate longer swings, several golf practice aids may be serially placed, and may include overlap therebetween when desired. An optional hoop is disclosed which is designed to assist with putting practice. An alternative embodiment more specifically for putting is also disclosed which provides a free standing assembly having two parallel rails and multiple upwardly extending hoops, the combination which may be formed as a unitary construction.

14 Claims, 3 Drawing Sheets

GOLF PRACTICE AID

BACKGROUND OF THE INVENTION

1. Field of the Invention

This invention pertains generally to projectile games, and more particularly to practice training aids which may assist a golfer in perfecting a golf swing. In one manifestation, the invention is a swing path indicator using horizontally spaced barriers made from guides and golf tees, which permits a golfer to monitor golf club head movement.

2. Description of the Related Art

Golf is a sport which has maintained much popularity over the years. In part, this may be because the sport is widely played by all age groups and both sexes. The rules are generally simple and readily understood, and the activity usually quite refreshing, conducted many times in very scenic and pleasant surroundings. However, as with most sports, mastery of the sport requires diligent training and much practice, and even then is essentially never fully achievable. Consequently, those golfers who have found ways to improve the efficiency of their practice have also been able to improve more quickly than their counterparts, with less practice time. This improved efficiency not only permits one to be better in the same amount of time, the overall enjoyment of the sport is improved, since less time is required in practice or drill, and more time may be spent enjoying the course and the competition.

In simplest terms, golf is simply a matter of propelling a club into a golf ball, which in turn rebounds from the club. More subtly, ball travel is influenced by relative motion occurring between club face and ball at the time of impact and contact therebetween. Consequently, various intended and unintended spins and travels are possible, depending upon the orientation of the club face and the relative motion between club and ball. Since drives of several hundreds of yards are possible, even very minor deviations in motion between club and ball at contact may result in very substantial deviations between where the ball was intended to go to and where it actually ends up.

In order to improve upon one's strokes, a common practice is to visit the driving range, where many balls may be hit in succession. With this type of training, a golfer will observe the path, or flight, that the golf ball takes after being stricken with the golf club. Based upon the trajectory, the golfer may impute a particular swing motion which may or may not be desirable. Unfortunately, a golf swing, particularly a drive, incorporates motion derived from many different parts of the golfer's body, such as, though not limited to, their shoulders, arms, hips, knees, and back. As but one example of the complexity that this introduces, those familiar with golf will recognize that what appears to be a slice may originate from a single sideways cut, or travel, transverse to the intended travel of the ball, but may also be derived from an "s" pattern in the golfer's swing. Correction of the swing will depend upon which motion is being produced by the golfer, since movement from different body parts may be the underlying cause for the ineffective swing. Unfortunately then, simply observing the flight of the ball will not always provide sufficient information for the golfer to accurately correct the swing error.

Another approach is that of visual monitoring or observation, either with a camera or through a second person monitoring the golfer. The use of a camera is not without significant hurdle or challenge. First and foremost is finding suitable placement of the camera. If the camera is placed in the general direction of ball travel, the golfer will be provided with the best optical vantage point to critique the swing. However, golfers will typically vary in placement of the ball, depending upon relatively minor variations, or sometimes major variations, in their swing. When the camera is in the general path of the ball, that also means the camera is in harm's way. There have been many instances where valuable video equipment has been destroyed by the impact of a very hard golf ball.

Unfortunately, the only other vantage point suitable for critiquing one's swing is that from nearly above the golfer, since side and back views will not provide any information regarding the path of the golf club head. As may be apparent, the apparatus required to elevate the camera is at best very awkward, and will present hazards of its own.

The use of an extra person to observe the golfer offers many benefits and advantages. Particularly where the observer is a seasoned golfer, the observer may then be able to instruct the golfer in particular techniques that may be of great benefit to the golfer. However, the use of an instructor, or even a less-skilled observer, requires two people for the golfer to train and improve. These two are the golfer and the observer. Consequently, economically, this approach is less desirable, since two people are required for the training or betterment of one and the coach will frequently require compensation. Furthermore, many golfers may be somewhat shy about their own need for practice and improvement, and may be unwilling to expend funds to retain such a coach.

Recognizing the need for better ways by which golfers may improve, without the embarrassment of an observer or the expense and risk associated with a camera, others have heretofore developed various swing training aids. One such patent which is exemplary of this body of prior art is U.S. Pat. No. 4,913,440 by Ellington, the teachings which are incorporated herein by reference. Ellington discloses a practice mat with holes in a pattern that support and receive a substantially modified golf tee and swing guide posts. The guide posts, which may be placed in various custom locations, serve as obstacles which may be useful for checking one's swing path. Unfortunately, when one swings with intent for distance, such as with a drive or long chip, the obstacles illustrated therein will seriously interfere with the golfer's movement, which may cause harm to either the golfer or the equipment, or may instead cause the mat to fly without the ball having been cleanly struck.

An earlier U.S. Pat. No. 2,152,381 by Harpster, the teachings which are also incorporated by reference, illustrates indicators that are knocked over when the golfer's swing deviates from the most desired path. Another similar variant using swing path indicators, the teachings which is also incorporated herein by reference, is shown in U.S. Pat. No. 6,786,833 by Ahrend. While these swing path indicators have much intrinsic possibility, they lack desirable ease and low cost of manufacture, and they are not readily transported by a golfer onto a course or other practice location owing to their necessary slightly larger and more obtrusive geometry.

Several additional patents illustrate parallel rails in swing training aids, which in turn may be used to force the swing path to follow the path of the rails. The teachings of these are likewise incorporated herein by reference, and include U.S. Pat. Nos. 4,023,811 by DeCota; 5,350,177 by Furbush; 5,411,266 by Guthry, and 5,320,355 and 5,785,604 by Johnson. Other patents are also incorporated herein by reference for their respective teachings, including: U.S. Pat. No. 3,166,326 by Mundy III; U.S. Pat. No. 2,712,939 by Harp; Des 277,886 by Murphy; Des 402,347 by Murphy; Des 406,298 by Murphy; U.S. Pat. No. 5,882,267 by Roe; U.S. Pat. No. 6,773,357 by Tai et al; U.S. Pat. No. 5,776,007 by Kendall et al; Des 470,906 by Shaw; Des 332,817 by Mullen; U.S. Pat. No. 2,992,005 by Lockhart; U.S. Pat. No. 3,899,179 by Vlach; U.S. Pat. No. 5,042,814 by Bennett; U.S. Pat. No. 5,362,057 by Arima; U.S. Pat. No. 5,910,053 by Scalise; Des 234,210 by Menendez et al; Des 311,568 by Jacques; Des 336,618 by Smith; and Des 338,940 by Pellington.

SUMMARY OF THE INVENTION

Exemplary embodiments of the present invention solve inadequacies of the prior art by providing parallel runners that are laid upon the ground or other suitable surface. In the preferred embodiment, the parallel runners each have a pattern of holes distributed longitudinally and at evenly spaced intervals, suitable to receive golf tees therein. The tees are then inserted, and will be arranged by the runners in two parallel rows. A golf ball may then be placed between the rows, and the golf club will pass therebetween as well, into contact with the ball. Any stroke deviation will be recognized by the tees within the runners being displaced therefrom, enabling a golfer to readily recognize an errant swing. The preferred embodiment may readily be lengthened, by overlapping a second like guide with the first. In an alternative embodiment, two parallel runners are spaced from each other by a plurality of hoops. Visual markings are provided at the apex of the hoops, to help distinguish an accurate ball travel. The runners and hoops serve as visual aids in the swing and subsequent ball travel.

In a first manifestation, the invention is a golf training apparatus. Parallel longitudinally extending rails each have a plurality of spaced holes. A plurality of golf tees are placed within the holes, thereby forming two parallel rows of golf tees spaced from each other. At least one spacer extends between the parallel rails and provides sufficient spacing to permit a suitable golf club to be placed between the golf tees without interfering therewith.

In a second manifestation, the invention is a golf practice aid providing positive visual feedback of golf club travel path. First and second longitudinally extensive rails are spaced from each other by a spacer extending therebetween, the spacer retaining the first and second rails in position relative to each other. A plurality of swing path indicators are coupled with the first and second longitudinally extensive rails along a longitudinal length thereof and are uncoupled therefrom when impacted by a golf club head.

In a third manifestation, the invention is a unitary golf training aid particularly suited to the practice of putting. In this manifestation, first and second parallel longitudinally extensive rails define horizontal bounds for a pathway therebetween suitable for a golf ball to traverse. A plurality of arcuate hoops couple the first rail to the second rail and define an upper boundary for the golf ball pathway.

OBJECTS OF THE INVENTION

A first object of the invention is to provide a golf practice aid which will accelerate the development of improved golf technique through the provision of a plurality of indicators useful in evaluating a golf swing. A second object of the invention is to provide a compact, readily manufactured and easily transported golf practice aid. Another object of the present invention is to utilize existing golf supplies as components of the golf practice aid. A further object of the invention is to enable expansion of the golf practice aid using a like golf practice aid. Yet another object of the present invention is to facilitate the practice of a plurality of different golf swings.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
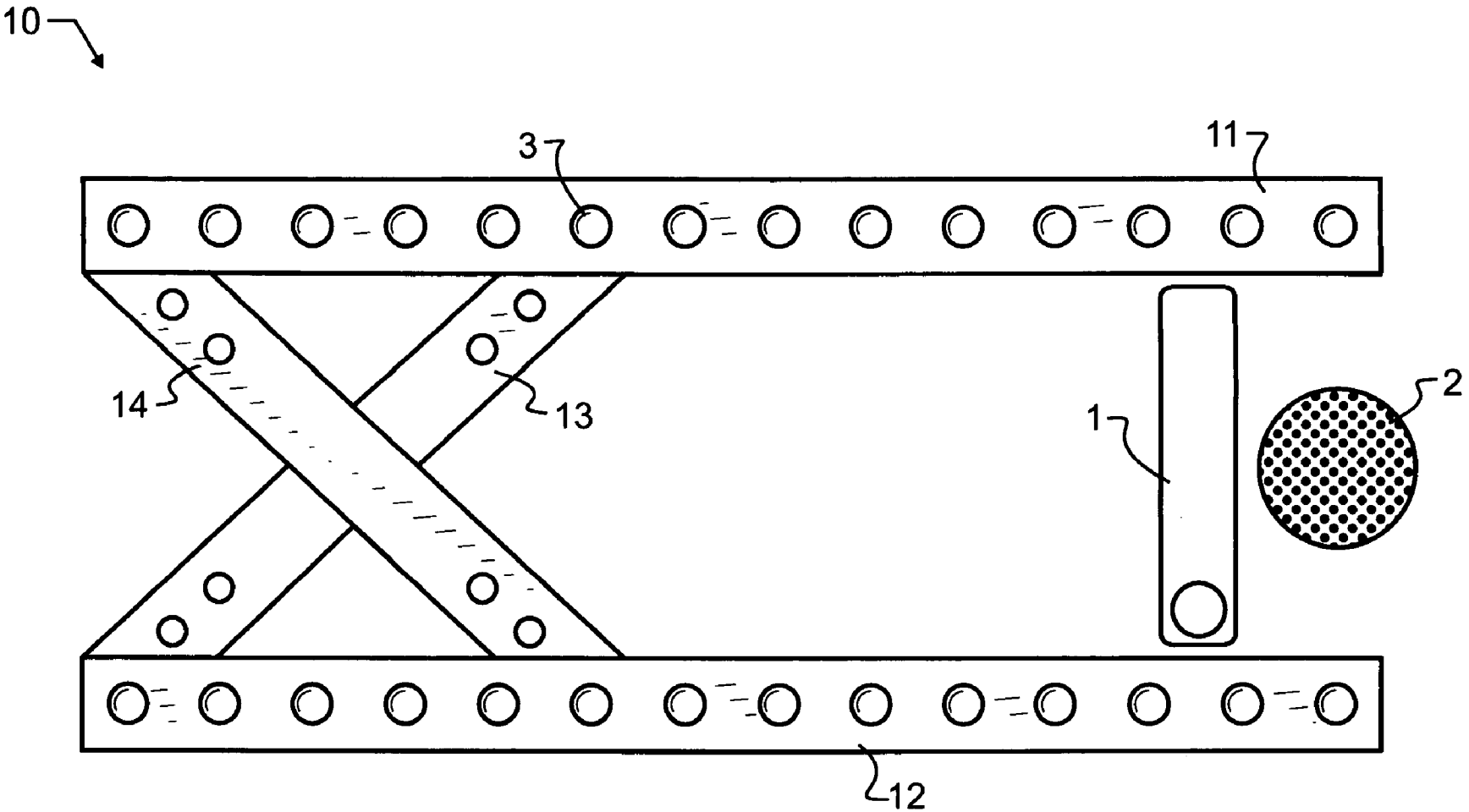
FIG. 1 illustrates a preferred embodiment golf practice aid designed in accord with the teachings of the present invention from a top plan view.
Figure 3:
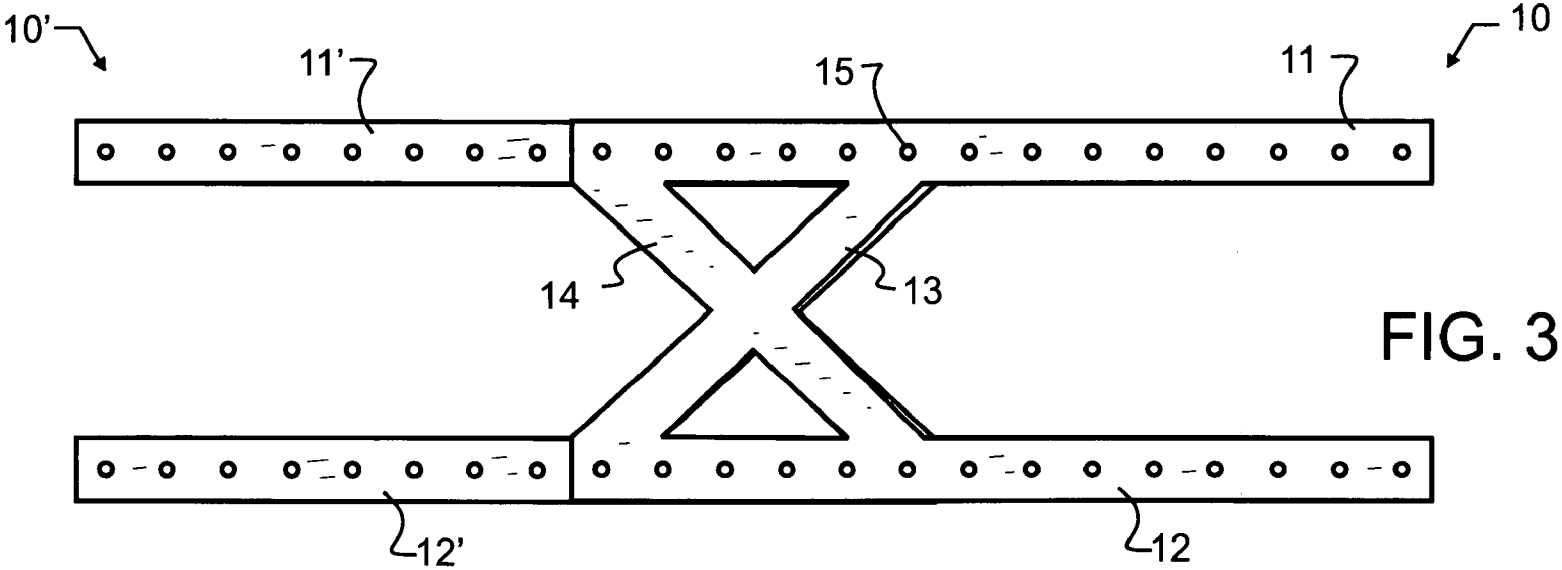
FIG. 3 illustrates the preferred embodiment golf practice aid of FIG. 1, in further combination with a like preferred embodiment golf practice aid, from a projected plan view.

Manifested in the preferred embodiment golf practice aid 10, the present invention provides parallel plastic rails 11, 12 with a plurality of equidistantly spaced holes 15, visible in FIG. 3, formed therein. A plurality of golf tees 3 will then be placed within holes 15, thereby forming two parallel rows spaced from each other as shown in FIG. 1. Between rails 11, 12 are two cross-spacers 13, 14 which are arranged generally in the shape of an "X". This geometry is preferred, since it provides a relatively strong and rigid alignment between rails 11 and 12, though it will be recognized that the specific arrangement of members 13, 14 may be quite different, so long as the spacing and alignment functions are performed by members 13, 14 adequately. Proper spacing will preferably be that amount which is sufficient to permit a suitable golf club 1 to be placed between rails 11, 12 without interfering with tees 3 or holes 15, and with reasonable clearance to permit minor or inconsequential deviations of motion.

It will be recognized that in some instances these cross-spacers 13, 14 might be adjustable to accommodate varying sized clubs 1 therebetween, or to permit the golfer to adjust the precision of monitoring desired for a given practice session. Such adjustment might simply be the provision of these cross-spacers 13, 14 as separate components which are held in place by tees 3, such that the angle of each cross-spacers relative to rails 1, 12 may be changed to thereby change the spacing between the rails. Other suitable techniques for lengthening or shortening cross-spacers 13, 14, or for differential placement such as with holes in the cross-spacers at various locations for coupling with holes 15, may be used as well.

The exact positioning of cross-spacers 13, 14 along the longitudinal length of rails 11, 12 is not critical to the operation of golf practice aid 10, though these cross-spacers 13, 14 will preferably be located to not interfere with the travel of golf ball 2 when golf ball 2 is placed directly upon the ground prior to a practice stroke. In other words, as illustrated in FIG. 1, cross-spacers 13, 14 are located near to one end of rails 11, 12. This permits ball 2 to be positioned in a relatively large area between rails 11, 12, and a golfer may then monitor swing path both prior to and subsequent to impact, if so desired. If cross-spacers 13, 14 are located more centrally, such as is the result of the embodiment of FIG. 3, then ball 2 may only be placed relatively nearer to one end or the other, instead of equidistant therebetween, owing to the interference that rails 13, 14 will otherwise produce.

According to the present invention, golf practice aid 10 may be fabricated from a variety of materials, which may include plastics, ceramics, metals or other suitable material. Any suitable manufacturing technique may be used, though the specific technique will likely be dictated to some degree by the material chosen. In preferred embodiment golf practice aid 10, the materials used are plastics which have sufficient durability to withstand the occasional impact from a golf club, the vagaries of the weather, moisture from a recent rain or watering, and the like. Suitable materials, for exemplary purposes only and not limiting thereto, might include nylon, Ultra-High Molecular Weight (UHMW) polyethylene, polypropylene, Acrylonitrile-Butadiene-Styrene (ABS), or other materials that have the desired combination of durability and ease of manufacture. While manufacturing techniques will depend in large part upon the particular materials utilized, it will be recognized that where plastics are used, a very large number of techniques will be suitable for the fabrication of golf practice aid 10, including though not limited to such techniques as injection molding, machining, stamping, vacuum thermoforming, rotomolding, and many other known techniques. Once again, the consideration of the appearance of the resultant product, the ability of a particular technique to produce suitable product, the cost for a given quantity, and other known factors will dictate the specific manufacturing technique.

Figure 2:
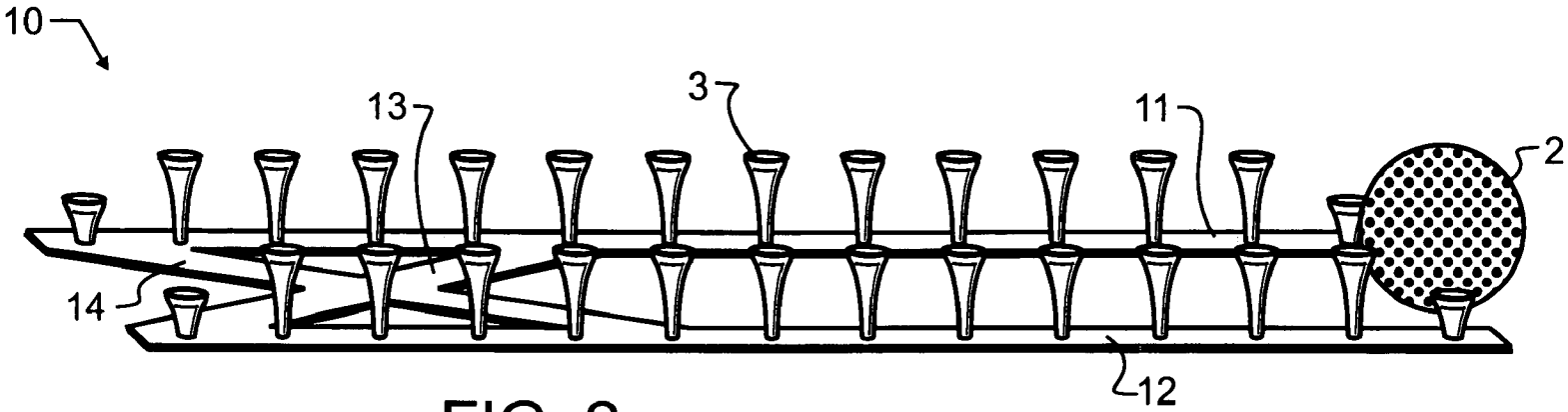
FIG. 2 illustrates the preferred embodiment golf practice aid of FIG. 1 from a projected plan view.

To use golf practice aid 10, a golfer will first place golf practice aid 10 upon a surface or the ground. When placed upon the ground, tees 3 are inserted through holes 15. Wherever desired, the golfer may push the tees fully into the ground, which serves to anchor golf practice aid 10. Typically the endmost tees will be pressed fully into the ground as illustrated in FIG. 2, and this will provide adequate anchoring. The remaining tees will only be slightly inserted into the ground, just sufficiently that they will not be blown over, but will only fall down if actually impacted by some solid object, such as a part of the club, ball, or other object. Next, a golf ball 2 will be placed between rails 11, 12, typically centrally therebetween and adjacent one longitudinal end thereof. At this point, golf practice aid 10 has been prepared for use. The golfer will then swing golf club 1 between rails 11, 12 and into contact with ball 2. It should be noted that golf ball 2 may be set upon a tee, or may alternatively be placed directly upon the ground or surface, depending upon which stroke is to be practiced.

When the golf stroke a follows a linear path parallel to and between rails 11, 12, none of the tees 3 will be knocked over. However, should the swing deviate, particular tees will be knocked down in a pattern which shows the deviation. If the swing path resembles an "S", then tees from both rails 111 and 12 will be knocked over in a recognizable pattern. If the stroke was more simply not centered upon ball 2, then only one rail or the other will have tees 3 knocked down. By observing the pattern of disturbed tees, the golfer will recognize the path of the club head, and will then be able to determine what changes are necessary to correct the stroke. Most preferably then, holes 15, and therefore tees 3, will be spaced sufficiently that one tee being knocked down will not likely knock the adjacent tee over. However, holes 15 should not be spaced so far apart that the distinct patterns of travel become unrecognizable. In the preferred embodiment, the spacing of holes is selected to be one inch, to accurately reflect swing path and not produce a domino effect between tees.

Not all holes 15 have to be occupied by tees 3. When a golfer wishes to explicitly practice a different swinging motion, various ones of tees 3 may be left from placement within holes 15, thereby leaving one or more selected paths from outside of rails 11, 12 to the space therebetween. Consequently, the club path which is being practiced may optionally be non-linear, without requiring rails 11, 12 to also be non-linear.

While golf practice aid 10 is configured for placement upon the earth and is anchored thereon through the insertion of tees 3 into the ground, it will be understood that where gentler strokes such as puts are to be practiced, it is conceived herein that tees may be inserted from the bottom side of golf practice aid 10 such that the tee points extend upwards from the surface. This configuration permits the use of golf practice aid 10 on various hard surfaces, though without the full benefits that are attained using the ground or other penetrable surface.

Depending upon the materials used in the production of golf practice aid 10, the longitudinal and planar rigidity may be selectively controlled through design. In other words, where the materials result in a stiff and rigid product, various features may be directly incorporated into golf practice aid 10 that change the stiffness and rigidity. For example, ridges or grooves may be included which permit selective flex within golf practice aid 10. These may permit flexure out of the natural planar geometry, or may permit individual rails to stay within the plane but flex out of linear alignment. While rails 11, 12 are parallel in the preferred embodiment, it will be recognized that in some instances it may be desirable to place rails 11, 12 in some other configuration. One conceived alternative embodiment involves the use of a material or machining of rails 11, 12 which will permit flexibility of placement, such that rails 11, 12 may be curved or deflected from the linear alignment shown in the figures herein. In such an alternative, a golfer may selectively curve rails 11, 12 to accommodate an intended or desired non-linear swing pattern.

FIG. 3 illustrates the combining of two like golf practice aids 10, simply by overlapping cross-spacers 13, 14. In this manner, rails 11, 12 are axially aligned with rails 11' and 12'. By such arrangement, it will be apparent that a much longer swing path may be accommodated simply by either aligning or overlapping more golf practice aids 10 with each other. Furthermore, from FIG. 3 it will be apparent one of the benefits of a relatively thin construction, since overlapping thicker materials would tend to raise the golf practice aid 10 into the swing path undesirably at the cross-spacers 13, 14 and points of overlap between adjacent golf practice aids 10.

Figure 4:
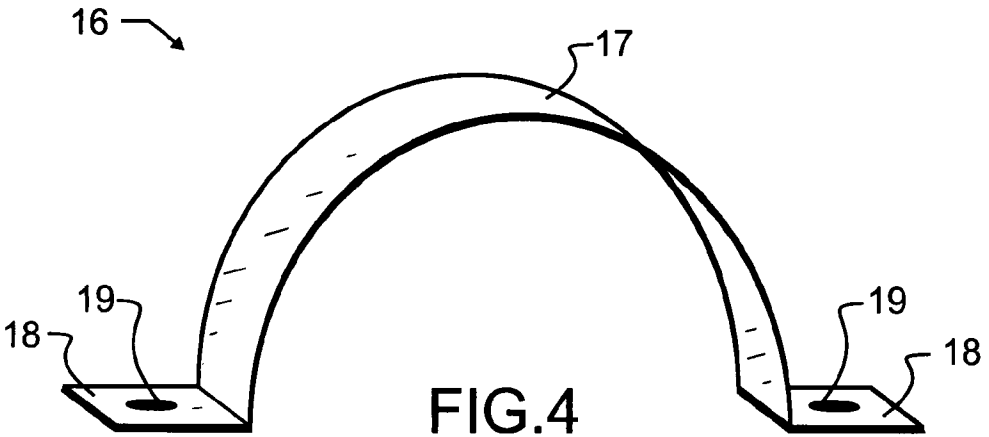
FIG. 4 illustrates an optional hoop that may be used in combination with the preferred embodiment golf practice aid of FIG. 1, from a projected plan view.

FIG. 4 illustrates an optional hoop 16 that may be used in combination with the preferred embodiment golf practice aid 10 of FIGS. 1-3. As illustrated therein, hoop 16 includes a pair of feet 18 connected together by an arc 17. Holes 19 are provided in feet 18, through which tees 3 may pass. Hoop 16 may then be placed between rails 11, 12 and anchored therewith using golf tees 3. Hoop 16 provides an optional means for monitoring a put, both by detecting stroke length and also by providing visual indication of ball path relative to arc 17.

Figure 5:
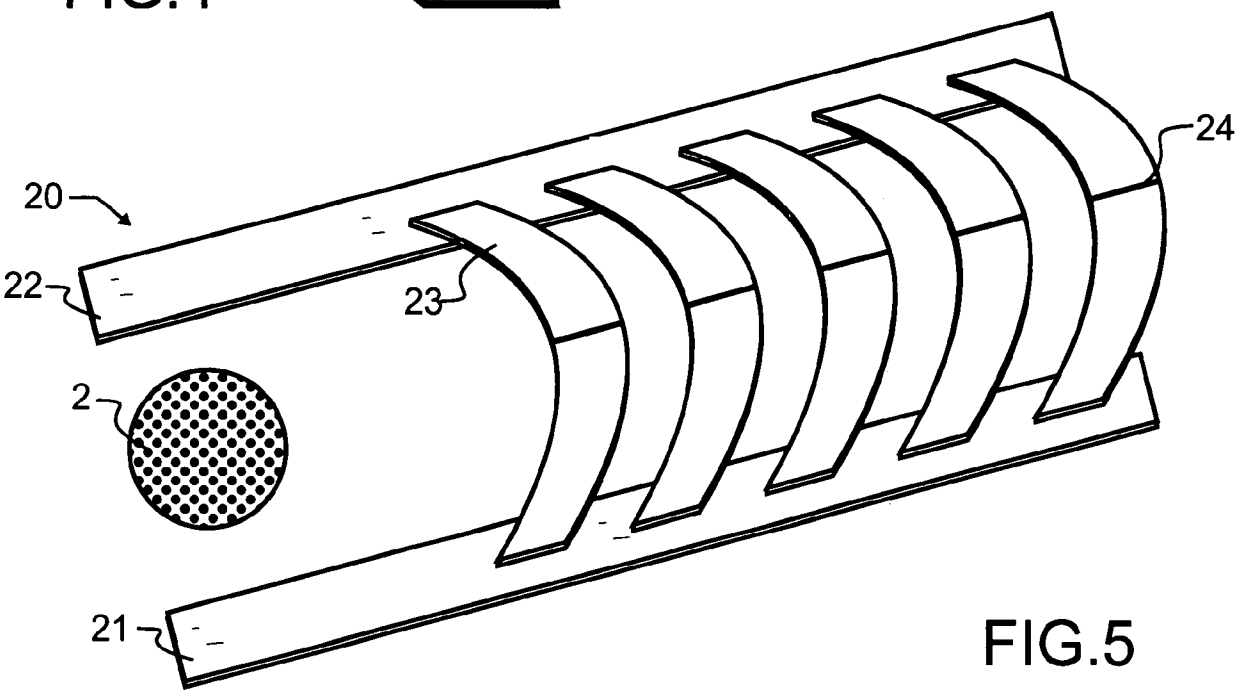
FIG. 5 illustrates a first alternative embodiment golf practice aid designed in accord with the teachings of the present invention from a projected plan view.

FIG. 5 illustrates a first alternative embodiment golf practice aid 20 which is designed to have particular utility in the practice of putting. Rails 21 and 22 are coupled to each other and held in parallel alignment by hoops 23. At the apex of hoops 23 are optional indicators 24, such as markings, paintings or the like, which simply provide visual indication of the center point of each hoop. Indicators 24 may then provide visual indication of the travel of ball 2 under hoops 23. While hoops 23 may be attached in any suitable way to rails 21, 22, in the preferred embodiment all of the components 21-24 of golf practice aid 20 are preferably formed unitarily. As with golf practice aid 10, the materials and methods of fabrication will be chosen by a designer suitably skilled in such matters.

While the foregoing details what is felt to be the preferred embodiment of the invention, no material limitations to the scope of the claimed invention are intended. Further, features and design alternatives that would be obvious to one of ordinary skill in the art are considered to be incorporated herein. As but one example of the myriad of possibilities, while golf tees are most preferred herein owing to their ready availability and well-suited geometry, other devices or means which perform the functions of placement with the rails and removal upon being stricken by the club head would be recognized as suitable alternatives. Such means might for exemplary purposes include various plastic nails, pins, or even devices which clip or otherwise attach to the rail structure. Consequently, such alternatives are incorporated herein, whether explicitly enumerated or not, and the scope of the invention is set forth and particularly described in the claims herein below.

I claim:

1. A golf training apparatus for use upon the ground, comprising:

parallel rails having a plurality of spaced holes passing through said rails and equidistantly spaced adjacent ends thereof;

a plurality of golf tees placed within said holes and extending therefrom sufficiently into said ground to resist being blown over, while falling down when impacted by a part of a golf club, ball, or other object, thereby forming two parallel rows of vertically extending golf tees spaced from each other;

at least two golf tees, each passing through one of said plurality of spaced holes into said ground to anchor said golf training apparatus to said ground during use;

at least one spacer extending between said parallel rails providing sufficient spacing to permit a suitable golf club to be moved between said parallel rails without interfering with said plurality of golf tees; and a second set of parallel rails and a second spacer of like construction to said parallel rails and at least one spacer, said second set of parallel rails overlapped and coupled end-to-end with said parallel rails, said at least two golf tees passing through both said parallel rails and said second set of parallel rails.

2. The golf training apparatus of claim 1, wherein said at least one spacer further comprises two cross-spacers.

3. The golf training apparatus of claim 2, wherein said two cross-spacers which are arranged generally in the shape of an X.

4. The golf training apparatus of claim 3, wherein said two cross-spacers terminate with a hole through which ones of said plurality of golf tees may pass, and are thereby angularly adjustable relative to said rails.

5. The golf training apparatus of claim 1, wherein said at least one spacer is adjustable, whereby said apparatus may accommodate varying sized clubs therebetween and permit a golfer to adjust the precision of monitoring desired for a given practice session.

6. A golf practice aid providing positive visual feedback of golf club travel path, comprising:

first and second longitudinally extensive rails spaced from each other;

a spacer extending between said first and second longitudinally extensive rails retaining said first and second rails in position relative to each other;

a plurality of golf tees passing through said first and second longitudinally extensive rails along a longitudinal length thereof and uncoupled from said first and second longitudinally extensive rails when impacted by a golf club head;

third and fourth longitudinally extensive rails spaced from each other and each having a plurality of holes along a length thereof;

a spacer extending between said third and fourth longitudinally extensive rails retaining said third and fourth rails in position relative to each other; and a plurality of golf tees passing through said third and fourth longitudinally extensive rails along a longitudinal length thereof and uncoupled from said third and fourth longitudinally extensive rails when impacted by a golf club head;

said third and fourth longitudinally extensive rails adjacent to an end of said first and second longitudinally extensive rails and generally axially aligned therewith;

said pattern of holes in said third and fourth longitudinally extensive rails aligned with holes in said first and second longitudinally extensive rails, and ones of said plurality of golf tees pass simultaneously through holes in both said first and third rails and simultaneously through holes in both said second and fourth rails.

7. The golf practice aid of claim 6, further comprising at least two anchoring members holding said first and second longitudinally extensive rails adjacent a surface.

8. The golf practice aid of claim 6, further comprising a hoop coupled with said first and second longitudinally extensive rails by said plurality of golf tees and defining a pathway for a golf ball there through.

9. The golf practice aid of claim 6, wherein said first and second rails are parallel with each other.

10. The golf practice aid of claim 6, wherein said spacer further comprises at least two crossed spacing members.

11. The golf practice aid of claim 6, wherein said spacer is adjacent a first termination of said rails and distal to a second termination.

12. A unitary golf training aid particularly suited to the practice of putting, comprising:

first and second parallel longitudinally extensive rails defining horizontal bounds for a pathway therebetween suitable for a golf ball to traverse; and at least one hoop coupling said first rail to said second rail and defining an upper boundary for said pathway; and at least one golf tee passing through said at least one hoop and at least one of said first and second rails coupling said at least one hoop to said at least one of said first and second rails.

13. The unitary golf training aid of claim 12 further comprising a visual indicators at an apex of a one of said at least one hoop.

14. The unitary golf training aid of claim 12 further comprising a plurality of golf tees passing through said first and second parallel longitudinally extensive rails into ground to anchor said first and second parallel rails thereto.

* * * * *